United States Patent [19]

Williams

[11] 4,210,986

[45] Jul. 8, 1980

[54] TILT RELEASE CATCH

[76] Inventor: Curtis Williams, 200 Center Plz., Apt. 321, Tulsa, Okla. 74119

[21] Appl. No.: 11,380

[22] Filed: Feb. 12, 1979

Related U.S. Application Data

[63] Continuation-in-part of Ser. No. 881,536, Feb. 27, 1978, abandoned.

[51] Int. Cl.[2] ..... A44B 11/25; A44B 11/12

[52] U.S. Cl. ..... 24/230 TC; 24/230 A; 24/170

[58] Field of Search ..... 24/230 TC, 230 A, 201 R, 24/191, 170

[56] References Cited

U.S. PATENT DOCUMENTS

| | | | |
|---|---|---|---|
| 2,110,684 | 3/1938 | Schuhmann | 24/77 R |
| 3,370,329 | 2/1968 | Takada | 24/230 A |
| 3,883,932 | 5/1975 | Meiller et al. | 24/230 A |

*Primary Examiner*—Alexander Grosz

*Attorney, Agent, or Firm*—Head & Johnson

[57] ABSTRACT

A tilt release catch comprising a housing member having a dog supported in a housing and constantly pressing against an opposite wall, a male member adapted for insertion between the dog member and a wall, and having an aperture for receiving one end of the dog therein in a locking position therebetween, and a stud member provided between the male member and the dog for releasing the engagement of the male member therefrom.

7 Claims, 5 Drawing Figures

TILT RELEASE CATCH

This is a continuation-in-part of application Ser. No. 881,536, now abandoned, filed on Feb. 27, 1978.

BACKGROUND OF THE INVENTION

1. Field of the Invention

This invention relates to belt buckles, and more particularly to seat belt buckles; but, as the name implies, is not limited to these uses and is applicable wherever a catch of the nature described below is needed.

An object of this invention is the provision of a catch which will allow instant escape from a vehicle if used as a seat belt buckle, or instant release of cargo if used as a carge buckle. When used as a seat belt, this catch can be adjusted to release with the slap of a hand or the push of an arm struggling to be freed. The advantages of this characteristic can be easily seen—in many accidents survival depends in escaping the vehicle instantly, i.e., if it is burning or about to fall from an escarpment. This adjustment is determined by the producer in advance of fabrication in the preferred embodiment, but the concept includes an adjustment in the produced article. By elevating the stud further from the bottom of the male member, more tilt is required to depress the dog and spring and thereby release the male member; also by shortening the stud the same objective is accomplished. Whether the mechanism is adjusted for hair trigger release or for deliberate release, it is a faster release than that available in conventional button release seat belts.

2. Description of the Prior Art

The prior art is replete with buckles having housings, snaps, and levers of one type or another—i.e. C. J. Schumann's Snap Lock Buckle (U.S. Pat. No. 2,110,684)—and many safety belt buckles have been cited in the prosecution of the prior and pending application.

SUMMARY OF THE INVENTION

The preferred embodiment of this invention includes a housing provided with a seat for a spring and means to secure a pivoting dog within the walls of the housing. Said dog may be displaced by the insertion of a male member between the blade of the dog and the rear wall until the blade slot of the male member is held within the housing. The male member is released when it is tilted inward until its stud displaces the dog and spring, removing the blade from the blade slot. The housing must be provided with means such as a slot to hold the belt to which it is usually appended, unless it is anchored in other fashion which is also comprehended in this concept. In the preferred model the slot flange is an extension of the rear wall. Also in the preferred model the blade slot of the male member is horizontal rather than vertical in normal usage and is not accidentally released by pressure from the front while being protected also from accidental release from the rear by the rear wall. The release of the preferred model is accomplished by a downward and forward stroke upon the upper edge of the male member, pressing it into the dog and thereby releasing it.

DESCRIPTION OF THE PREFERRED EMBODIMENT

A tilt release catch comprises a housing 1 with slot flange 2 having slot 2*a* to which belting may be fastened, and in front wall 1*b* spring steel dog 3 is connected by rivet 3*d*, said dog 3 including indentation 3*a* which allows its limited entry into blade slot 4*c*, dog edge 3*b*, which is curved, and the dog foot 3*c* which is a flange presenting a smooth entry and removal of dog 3. The male member includes thumb plate 4*a* by which the tip of the thumb or the butt of the hand may depress it forward, causing it to depress and release the dog 3*b* to which belting is normally attached; and the male member also includes blade slot 4*c* and stud 4*e*.

DESCRIPTION OF SPECIES II

Figure 1:
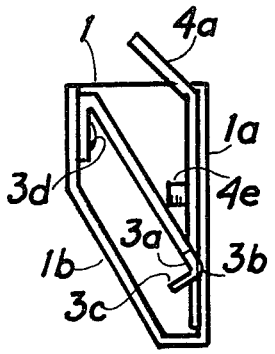
FIG. 1 is a side view in elevation of Species I, showing the assembled catch from the open end of the housing.
Figure 2:
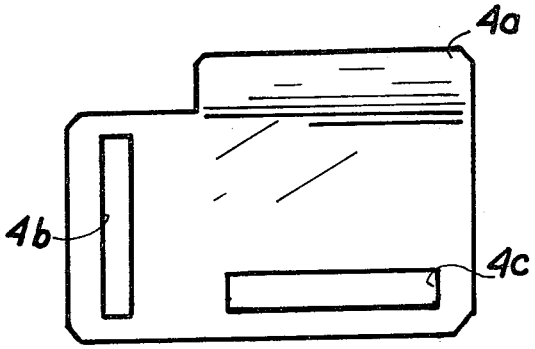
FIG. 2 is a rear view in elevation of the male member in which the stud is not seen, being on the reverse side.
Figure 5:
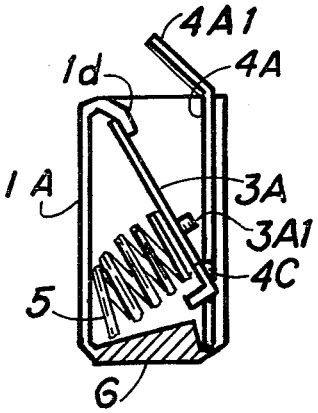
FIG. 5 is a side view of Species II, which differs from Species I only in the aspects shown.
Figure 3:
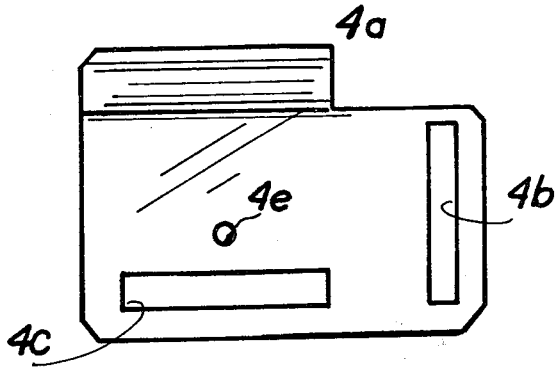
FIG. 3 is a front view in elevation of the male member with stud shown.
Figure 4:
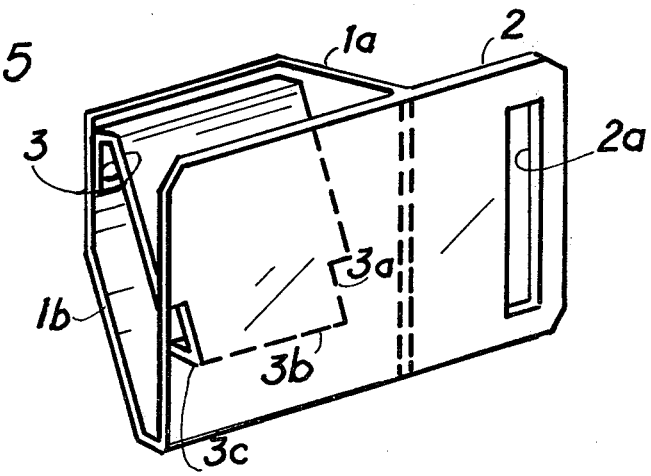
FIG. 4 is a perspective view of the housing.

The concept of this invention suggests and includes the placement of the stud upon either the male member or upon the dog, and FIG. 5 illustrates this embodiment which differs from the preferred embodiment only in the aspects shown in the drawing. As may be seen, the dog 3A has stud 3A1; and male member 4A has no stud. Rear wall 1B is not at an acute angle relative to the opposite wall 1A as was the case in the embodiment preferred in the prior application; the spring 5 is not helical, and it supports floating dog 3A which pivots beneath retaining flange 1d. Blade guard 6 prevents the lower end of the male member from moving in the wrong direction and allows it to be tilted only toward and not away from the dog.

What is claimed is:

1. A tilt release catch comprising a housing member having a dog supported in a housing and constantly pressing against an opposite wall, a male member adapted for insertion between the dog member and said opposite wall and having an aperture for receiving one end of the dog therein in a locking position therebetween, and a stud member provided between the male member and the dog for releasing the engagement of the male member therefrom.

2. A tilt release catch as set forth in claim 1 wherein the dog is urged against the opposite wall by a spring interposed between a wall and the dog.

3. A tilt release catch as set forth in claim 1 wherein the dog is itself composed of a springy material and urges itself against the opposite wall.

4. A tilt release catch as set forth in claim 1 wherein the stud is located upon the male member.

5. A tilt release catch as set forth in claim 1 wherein the stud is mounted upon the dog.

6. A tilt release catch as set forth in claim 1 including a blade guard to cause the male member to be tilted only toward the dog.

7. A tilt release catch as set forth in claim 1 wherein a spring urged floating dog is retained by and pivots beneath a retaining flange.

* * * * *